US011834868B2

(12) United States Patent
Libert et al.

(10) Patent No.: US 11,834,868 B2
(45) Date of Patent: Dec. 5, 2023

(54) CABIN PROVIDED WITH A DEVICE FOR LOCKING AND UNLOCKING DOORS AND PASSENGER TRANSPORT FACILITY COMPRISING AT LEAST ONE SUCH CABIN

(71) Applicant: POMA, Voreppe (FR)

(72) Inventors: Xavier Libert, La Murette (FR); Thierry Vittoz, Chimilin (FR)

(73) Assignee: POMA, Voreppe (FR)

( * ) Notice: Subject to any disclaimer, the term of this patent is extended or adjusted under 35 U.S.C. 154(b) by 456 days.

(21) Appl. No.: 17/187,244

(22) Filed: Feb. 26, 2021

(65) Prior Publication Data

US 2021/0293054 A1 Sep. 23, 2021

(30) Foreign Application Priority Data

Feb. 28, 2020 (FR) ..... 2002019

(51) Int. Cl.

| | |
|---|---|
| ***A63G 27/08*** | (2006.01) |
| ***E05C 3/06*** | (2006.01) |
| ***E05B 65/00*** | (2006.01) |
| ***A63G 27/00*** | (2006.01) |
| ***E05B 47/00*** | (2006.01) |

(52) U.S. Cl.

CPC ..... *E05B 65/00* (2013.01); *A63G 27/00* (2013.01); *E05B 47/0002* (2013.01); *E05C 3/06* (2013.01)

(58) Field of Classification Search

CPC ... A63G 1/00; A63G 1/02; A63G 1/08; A63G 1/10; A63G 27/00; A63G 27/02; A63G 27/08; E05C 3/06

USPC ..... 472/29–35, 45–46

See application file for complete search history.

(56) References Cited

U.S. PATENT DOCUMENTS

| | | | | |
|---|---|---|---|---|
| 8,777,762 | B2 * | 7/2014 | Morand | A63G 29/02 472/44 |
| 2009/0320712 | A1 * | 12/2009 | MacMahon | A63G 7/00 104/76 |
| 2012/0260816 | A1 * | 10/2012 | Vittoz | A63G 27/00 104/76 |

* cited by examiner

*Primary Examiner* — Kien T Nguyen

(74) *Attorney, Agent, or Firm* — Ray Quinney & Nebeker P.C.; Paul N. Taylor

(57) ABSTRACT

The invention relates to a cabin for transporting passengers, comprising at least one door (P1, P2), an interior floor (C) and a doorsill (S) located on either side of the door, and a locking device comprising a lug (E) which is rigidly connected to the door and projects toward the outside of the cabin, and a catch finger (4) that is movable between a locked position and an unlocked position. The invention also relates to an actuating mechanism comprising a pedal (7) which is located under the interior floor (C) of the cabin and can be accessed via a hatch in the floor of the cabin, and a kinematic connection between the pedal (7) and the finger (4), which connection is located under the interior floor (C) and under the doorsill (S) of the cabin. In the locked position, the finger is an abutment on the path of the lug (E). In the unlocked position, the finger is retracted under the doorsill (S) of the cabin.

17 Claims, 7 Drawing Sheets

CABIN PROVIDED WITH A DEVICE FOR LOCKING AND UNLOCKING DOORS AND PASSENGER TRANSPORT FACILITY COMPRISING AT LEAST ONE SUCH CABIN

TECHNICAL FIELD OF THE INVENTION

The present invention relates to the locking and unlocking of doors of cabins which transport passengers and move along a path of which the angle with respect to the horizontal is not constant.

In particular, the invention can be implemented in transport facilities used in amusement parks such as "big wheels" or Ferris wheels.

PRIOR ART

Such facilities are in particular described in DE 476 892 and WO 2012/140330, in which they comprise spherical cabins which are supported by a movable structure that rotates about an axis of rotation relative to a fixed structure, and which are rotated about an axis parallel to the axis of rotation relative to the movable structure.

The cabins used in these facilities are generally provided with lateral doors which allow passengers to board and disembark, each door being provided, in the upper part, with an opening and closing member and, in the lower part, with a lug that projects toward the outside and, in the closed position, abuts a catch finger that can retract under the floor of the cabin in the open position.

These doors are thus provided with secure means that open and close said doors in an automatic and locked manner at an access landing located in the lower part of the facility.

Such means for automatically opening and closing Ferris wheel cabin doors are described in CN206342901U and JP2006075526A. These means are designed in a secure manner to prevent accidental or deliberate opening from inside the cabins.

However, if the facility breaks down, some cabins will be stuck at high altitude and it may be necessary to unlock the doors to allow them to be opened and to allow the passengers to be evacuated using external equipment.

In other circumstances, the doors may become blocked accidentally, preventing the passengers from getting out at the disembarking landing.

Furthermore, during facility maintenance and for practical reasons, it may be useful for the operators to open the doors from the inside of the cabins, which would require prior unlocking.

However, the cabins do not have means for unlocking the doors which can be accessed and actuated from the inside. Nevertheless, for obvious safety reasons, such unlocking means should not be easily accessible, even inadvertently, at the risk of causing accidental falls.

DISCLOSURE OF THE INVENTION

In this context, the aim of the invention is that of providing a solution which is technically simple, reliable, and secure, which allows traditional locking/unlocking of the doors from the outside while also providing the option of occasionally, manually and simply unlocking from the inside of the cabin in emergencies or for maintenance, and which is not an impediment or hindrance to passengers entering and leaving the cabin.

This aim is achieved by means of a cabin comprising at least one door that is movable between an open position and a closed position, an interior floor and a doorsill located on either side of the door in the closed position, the cabin comprising a locking and unlocking device which has a lug that is rigidly connected to the door and projects toward the outside of the cabin, and a catch finger that is movable between a locked position and an unlocked position, said finger being, in the locked position, an abutment on the path of the lug from the closed position to the open position of the door, wherein the catch finger, in the unlocked position, is retracted under the doorsill of the cabin, the locking and unlocking device comprising an actuating mechanism, the actuating mechanism comprising a pedal located under the interior floor of the cabin, and a kinematic connection between the pedal and the catch finger, which connection is located under the interior floor of the cabin and the doorsill of the cabin.

The pedal can preferably be accessed via an access hatch in the interior floor of the cabin. When it is necessary to manually open the door from the inside of the cabin, the pedal can be accessed by lifting the hatch and easily operate the mechanism. This operation can be carried out by a passenger receiving external instructions or by an operator who has entered the cabin via a roof hatch.

According to one preferred embodiment of the invention, the kinematic connection comprises a lever which is mounted on a pin and supports the finger and the pedal, the pedal preferably being between the pin and the finger, the lever being movable between a first position in which the catch finger is in the unlocked position and a second position in which the catch finger is in the locked position.

According to a specific variant, the actuating mechanism comprises an actuator capable of driving the lever from the first position to the second position. This actuator can be monostable, for example with a stable position corresponding to the locked position of the finger, or bistable, with both the locked position and the unlocked position being stable positions.

According to an advantageous feature of the cabin of the invention, the actuator is connected to the lever via a reversing lever that pivots about an axis parallel to the pin, a body of the actuator being mounted so as to pivot about an axis parallel to the pin. A mechanism of this kind allows advantageous torque reduction.

The lever and the actuator are preferably mounted so as to pivot on a frame of the actuating mechanism fixed to a frame of the cabin, and the pin pivots about a substantially horizontal axis.

According to another variant, the actuator comprises an electromagnetic cylinder comprising a translationally movable rod of which one end is attached to the reversing lever.

According to another feature, the catch finger supports a sole which, in the open position, is accommodated in a cavity arranged in the doorsill of the cabin. The sole optionally consists of a second pedal that allows the locking device to be actuated by an operator from the outside of the cabin. Alternatively, the catch finger itself consists of a pedal. For this purpose, raised elements or texturization of the projecting end of the catch finger can be provided for easy operation with a foot.

According to another feature, the catch finger is designed so as to be biased by the lug in a direction counter to the unlocked position when the lug abuts the catch finger.

According to other features, the locking and unlocking device is coupled to members for opening and closing the door and is disengageable.

Furthermore, a channel that passes through the doorsill is formed so as to accommodate the catch finger.

Another object of the invention is a passenger transport facility comprising at least one cabin as described above, supported by a movable structure that rotates about an axis of rotation relative to a fixed structure, and rotated about an axis parallel to the axis of rotation relative to the movable structure.

The locking and unlocking device provided to the cabins of the invention is very compact and can thus be easily accommodated under the floor of the cabin. In emergencies, this device provides a possibility of unlocking by pressing on the pedal with a foot from the inside of the cabin without compromising the safety of passengers in a normal transport situation.

BRIEF DESCRIPTION OF THE DRAWINGS

Other features and advantages of the invention can be found in the description below, with reference to the appended drawings, in which.

For greater clarity, identical or similar elements are denoted by identical reference signs in the text and in the drawings.

Of course, the embodiments of the invention shown by the appended drawings and described below are given only as non-limiting examples. It is explicitly stated that it is possible to suggest and combine different embodiments so as to suggest other embodiments.

DETAILED DESCRIPTION OF THE EMBODIMENTS

The cabin of the invention is provided with a device intended to lock and unlock the doors. This cabin is integrated in passenger transport facilities, and more particularly facilities of the "big wheel" or Ferris wheel type which can usually be found in amusement parks.

Figure 1A:
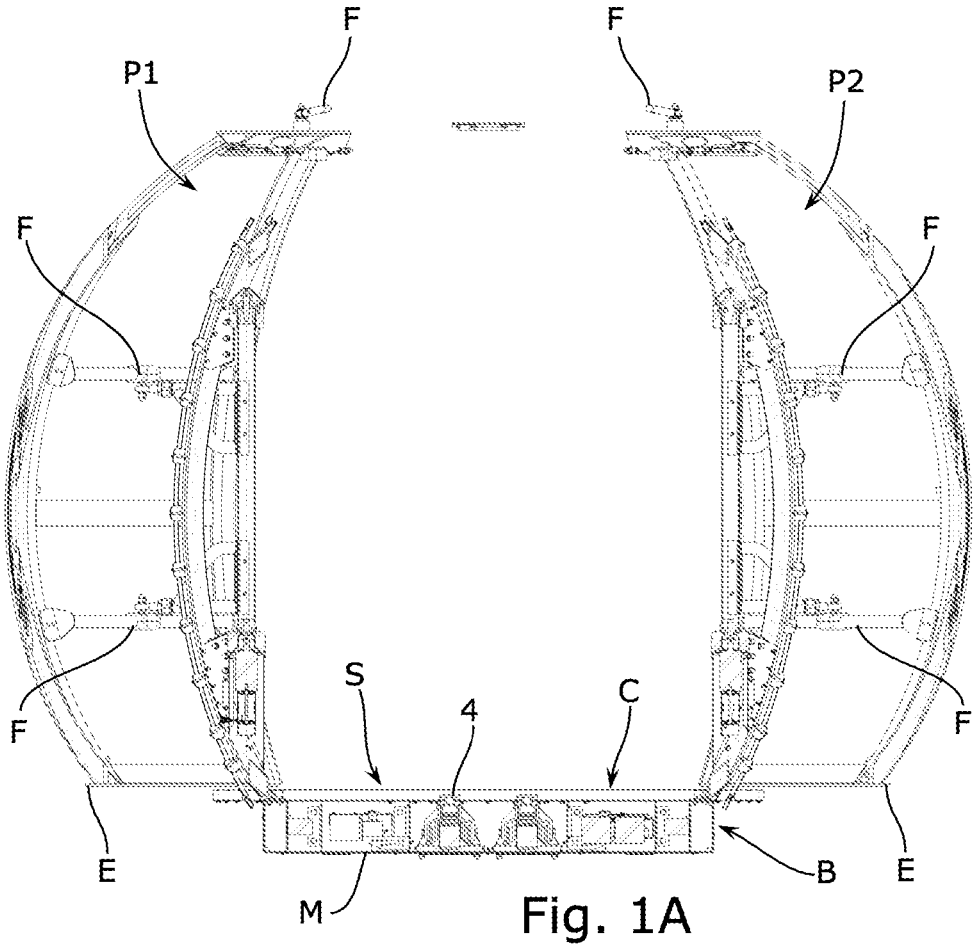
FIG. 1A is a frontal view of a cabin according to the invention provided with an embodiment of the locking and unlocking device, with the doors in the open position.
Figure 1B:
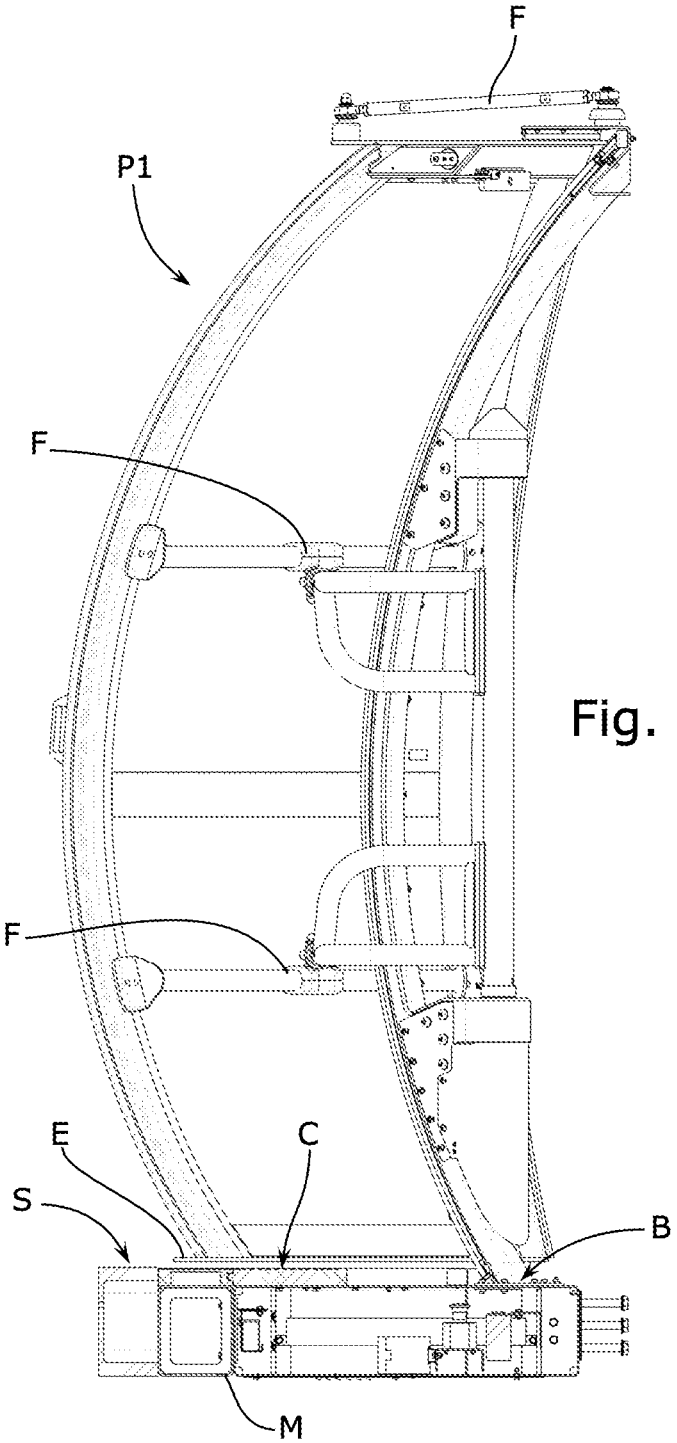
FIG. 1B is a lateral view of the cabin from FIG. 1A.

The cabins have a generally spherical shape, as shown in part in FIGS. 1A and 1B. Said cabins are supported by a movable structure that rotates about an axis of rotation (not shown) relative to a fixed structure (not shown), and rotated about an axis parallel to the axis of rotation relative to the movable structure.

This cabin comprises at least one door P1, P2 that is movable between an open position and a closed position, an interior floor C and a doorsill S being located on either side of the doors in the closed position. Each of the doors (here doors P1, P2) is provided with opening and closing members F located in the upper part and on the sides of the opening for guiding a lift-and-slide movement.

The cabin is also provided with a locking and unlocking device comprising a lug E which is rigidly connected to the door and projects toward the outside of the cabin, and a catch finger 4 that is movable between a locked position and an unlocked position.

In the locked position, the finger 4 is an abutment on the path of the lug E from the closed position to the open position of the door. In the unlocked position, the finger 4 is retracted or stowed under the doorsill S of the cabin. The finger 4 can advantageously be provided with a V-shaped indentation 44 oriented so as to come into contact with the lug E when an attempt is made to open the lift-and-slide door P. The indentation 44 forms a ramp which aims to raise the finger 4 when the opening force of the lug E is applied.

In a manner known per se, the members F for opening and closing the doors are coupled to the locking/unlocking device via an electromechanical system controlled by a microprocessor. In this configuration, the doors are opened and closed and locked in an automatic and synchronized manner at an access landing located in the lower part of the facility and intended for the boarding and disembarking of passengers.

The aim of the invention is that of improving the current automatic locking/unlocking means by providing them with a manual unlocking member that can be accessed from the inside of the cabin.

According to the invention, the locking device comprises, for this purpose, an actuating mechanism that comprises a pedal 7 which is located under the interior floor C of the cabin and can be accessed via a hatch in the floor thereof, and a kinematic connection between the pedal 7 and the catch finger 4, this connection being located under the interior floor C and under the doorsill S of the cabin, which is located on a level with the floor here.

Figure 2:
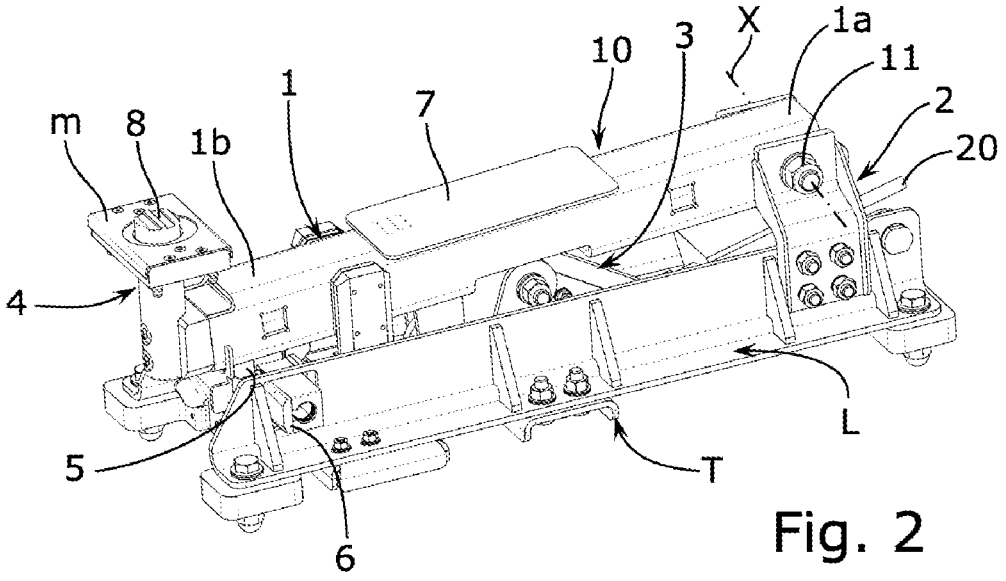
FIG. 2 is a perspective view of an embodiment of the locking and unlocking device intended to be provided to the cabin of the invention.
Figure 5A:
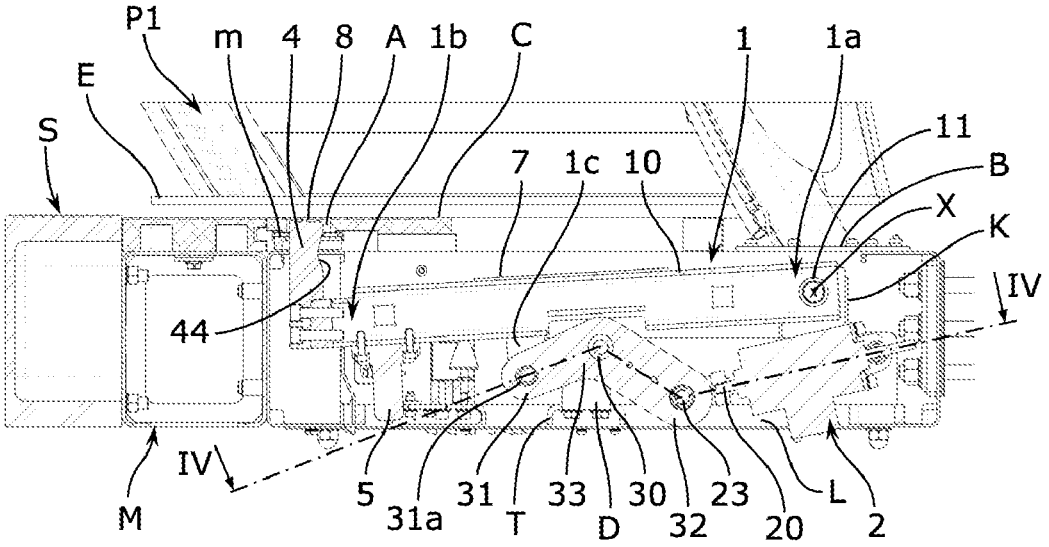
FIG. 5A is a lateral section along the plane V-V of the device shown in FIG. 3B in its compartment under the cabin when the doors are in the locked position.
Figure 5B:
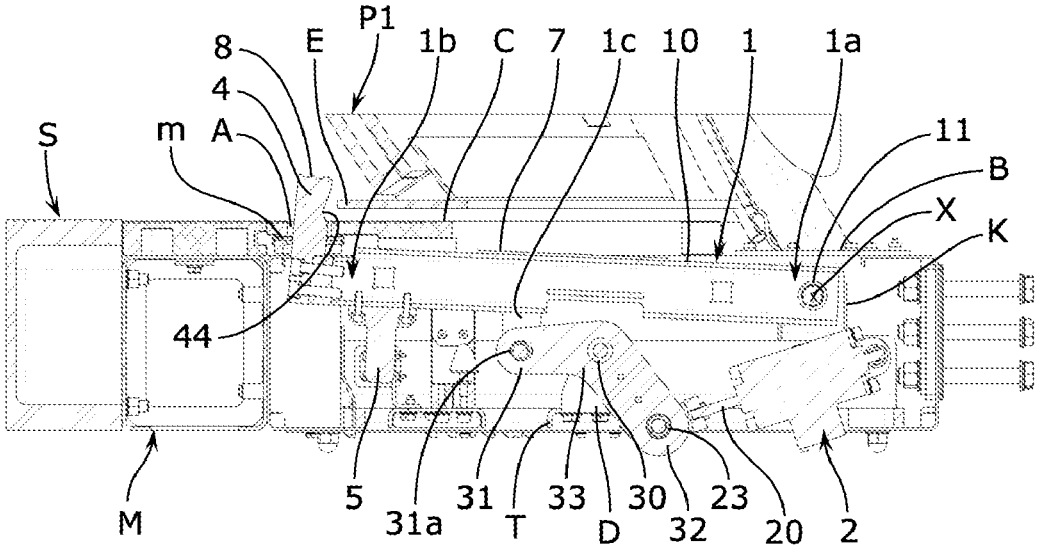
FIG. 5B is a lateral section along the plane V-V of the device shown in FIG. 3B when the doors are in the unlocked position.

In the preferred embodiment shown in particular in FIGS. 2 and 5A, 5B, the kinematic connection comprises a lever 1 which is mounted on a pin 11 and supports the catch finger 4 and the unlocking pedal 7. The pedal 7 is preferably mounted between the pin 11 and the finger 4, and the lever 1 is movable between a first position in which the catch finger 4 is in the retracted unlocked position of the doors and a second position in which the finger 4 is extended over the doorsill S in the locked position of the doors.

The actuating mechanism comprises an actuator 2 capable of driving the lever 1 from the first position to the second position. For this purpose, the actuator 2 is connected to the lever 1 via a reversing lever 3 that pivots about an axis parallel to the pin 11, an end part of the body of the actuator being mounted so as to pivot about an axis parallel to the pin 11.

The lever 1 and the actuator 2 are preferably mounted so as to pivot on a frame of the actuating mechanism fixed to a frame of the cabin, and the pin 11 pivots about a substantially horizontal axis.

Figure 4:
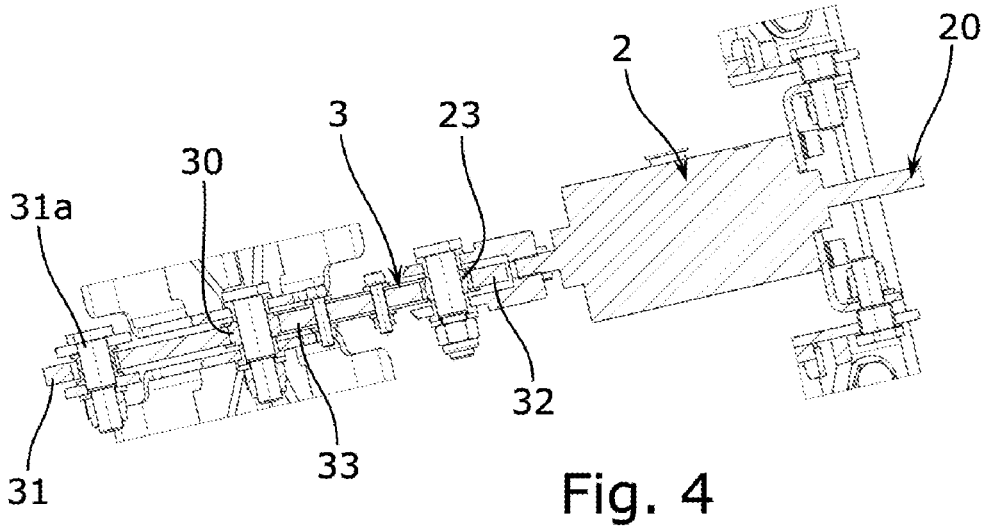
FIG. 4 is a partial section along planes IV-IV, represented by a dotted line, of the device shown in FIG. 5A, in rear view.

In the preferred embodiment shown, the lever 1 is in the form of a longitudinal profile arranged under the floor C of the cabin and the actuator 2 and here comprises an electromagnetic cylinder that comprises a translationally movable rod 20 of which one end is attached to the reversing lever 3 via an articulated connection (FIG. 4). This actuator 2 is coupled to members F for opening and closing the door and is disengageable.

The pedal 7 is mounted in the upper part 10 of the profile that forms the lever 1, and is intended to be pressed by a passenger's or maintenance operator's foot with the aim of carrying out a "manual" unlocking, in particular in emergencies. The pedal 7 is preferably mounted on and fixed to the lever 1.

The kinematic connection between the pedal 7 and the finger 4 is described in detail below. The end of the lever 1 located inside the cabin and under the floor C (hereinafter referred to as interior end 1*a*) is mounted on the pin 11 that has a substantially horizontal axis X, while the other end of said lever, which end is located outside the cabin under the doorsill S (referred to as exterior end 1*b*), supports the catch finger 4, as shown by FIGS. 2, 5A and 5B.

The catch finger 4 has a textured upper surface 8 to facilitate pressing with a foot without slipping. In the open position, the catch finger 4 is accommodated in a cavity A arranged under the floor C of the cabin (FIG. 5A, 5B).

The exterior end 1*b* of the lever 1 is provided with a joint that provides both the connection with the structure B of the cabin under the floor C and the vertical range of movement of the catch finger 4.

This joint is provided with a coder 5 fixed under the profile member 1 coupled to a position sensor 6, as shown by FIG. 5A, 5B. The lateral ends of the sensor 6 are accommodated in openings arranged in the side members L, as shown by FIG. 2.

The reversing lever 3 comprises an L-shaped end plate here of which the ends 31, 32 are rotatably connected to the lower part of the lever 1 via a pin 31*a* supported by a first bracket 1*c*, and to the rod 20 of the actuator 2 by a first trunnion 23, respectively.

The central part 33 of the lever 3 is angled and connected to the cabin by a second trunnion 30 supported by a second bracket D. The bracket D is bolted on a crossmember T fixed on the structure B of the cabin under the floor C, as shown by FIGS. 2 and 5*a*. The actuator 2 is fixed to the structure B here with a slight downward tilt toward the reversing lever 3.

Figure 3A:
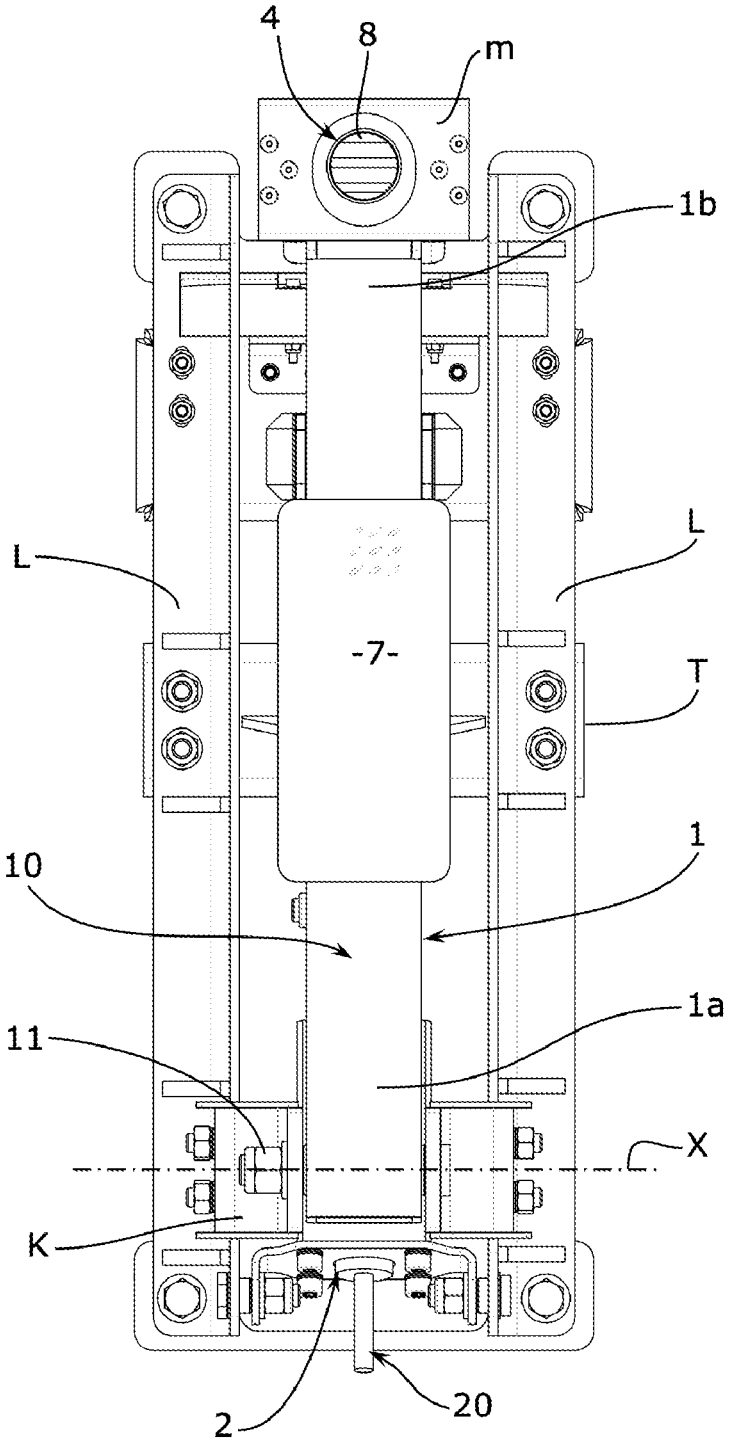
FIG. 3A is a plan view of the device from FIG. 2.
Figure 3B:
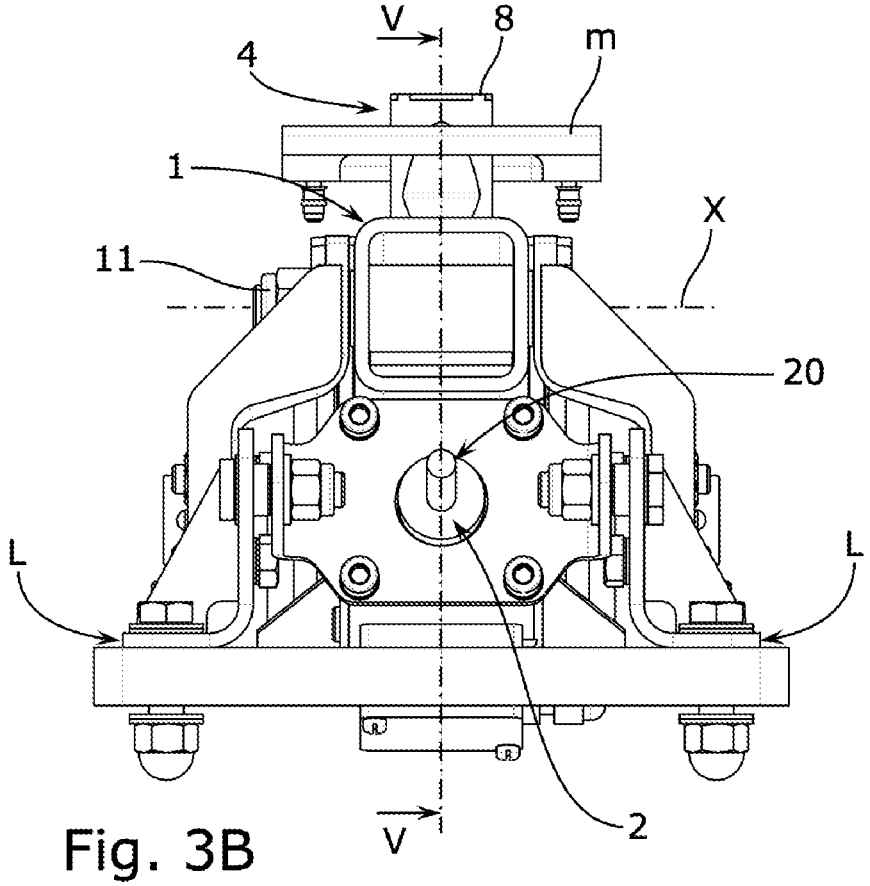
FIG. 3B is a rear view of the device from FIG. 2.

The pin 11 of the interior end 1*a* of the lever 1 is mounted on the axis B between two landings K that are rigidly connected to the side members L fixed on the structure B of the cabin, as shown by FIGS. 2 and 3A, 3B.

If the cabin is provided with two doors P1, P2, each door is provided with a locking and unlocking device of the invention. The devices are accommodated in a compartment M so as to be juxtaposed, which compartment is arranged under the cabin and can be accessed via the access hatch arranged in the floor C, as shown by FIGS. 1A, 1B and 5A. This compartment M is located on either side of the doors P1, P2 between the exterior doorsill S and the interior floor C of the cabin, and is provided, in its upper part, with sealing diaphragms m passed through by catch fingers 4 when they move upward and downward.

The cabin is locked automatically at the lower landing of the facility for passenger boarding, immediately after the doors P1, P2 are closed. For each door, this locking is achieved by activating the actuator 2 coupled to the members F for opening and closing the doors.

In the embodiment of the device of the invention shown in the drawings and described above, the locking is carried out as follows. The rod 20 of the actuator 2 is extended, here in a manner tilted downward, pushing the end 32 of the reversing lever 3, which therefore pivots about the axis of the trunnion 30. The end 31 of the lever 3 raises the exterior end 1*b* of the lever 1 upward, driving the finger 4 out of the cavity A through the channel m, in order to thus move from the stowed position from FIG. 5B to the projecting position from FIG. 5A in contact with the lug E of the corresponding door. The automatic unlocking is carried out according to reversed kinematics, prior to or at the same time as the opening of the doors.

Since the actuator 2 is disengageable, it is possible, by means of the invention, to carry out a manual unlocking with the intervention of a passenger or, for example, a maintenance operator.

In this situation, the person wishing to unlock the door, preferably using their foot, pushes either on the outside of the cabin on the sole 8 or from the inside of the cabin on the pedal 7 via the hatch of the compartment M. Pushing in this way causes the finger 4 to return to its housing A, pushing back the rod 20 of the actuator 2, with force if necessary if said actuator is not in the disengaged state.

The invention claimed is:

1. A cabin for a passenger transport facility, comprising:

at least one door that is movable between an open position and a closed position, an interior floor and a doorsill, the interior floor and the doorsill being located on either side of the door in the closed position, a locking and unlocking device comprising a lug that is rigidly connected to the door and projects toward an outside of the cabin and a catch finger that is movable between a locked position and an unlocked position, said finger being, in the locked position, an abutment on the path of the lug from the closed position to the open position of the door, wherein the catch finger in the unlocked position is retracted under the doorsill, the locking and unlocking device comprising an actuating mechanism, the actuating mechanism comprising a pedal located under the interior floor and a kinematic connection between the pedal and the catch finger, which kinematic connection is located under the interior floor and the doorsill.

2. The cabin of claim 1, wherein the kinematic connection comprises a lever which is mounted on a pin and supports the finger and the pedal, the lever being movable between a first position in which the catch finger is in the unlocked position and a second position in which the catch finger is in the locked position.

3. The cabin of claim 2, wherein the actuating mechanism comprises an actuator capable of driving the lever from the first position to the second position.

4. The cabin of claim 3, wherein the actuator is connected to the lever via a reversing lever that pivots about an axis parallel to the pin, a body of the actuator being mounted so as to pivot about an axis parallel to the pin.

5. The cabin of claim 4, wherein the lever and the actuator are mounted so as to pivot on a frame of the actuating mechanism fixed to a frame of the cabin.

6. The cabin of claim 4, wherein said actuator comprises an electromagnetic cylinder comprising a translationally movable rod of which one end is attached to the reversing lever.

7. The cabin claim 2, wherein the pin pivots about a substantially horizontal axis.

8. The cabin of claim 2, wherein the pedal is between the pin and the finger.

9. The cabin of claim 2, wherein the catch finger is operational to be biased by the lug in a direction counter to the unlocked position when the lug abuts the catch finger.

10. The cabin of claim 2, wherein the at least one door is provided with opening and closing members, said locking and unlocking device being coupled to said opening and closing members and being disengageable.

11. The cabin of claim 2, wherein the pedal is accessible via an access hatch in the interior floor.

12. The cabin of claim 2, provided with a channel passing through the doorsill for accommodating the catch finger.

13. The cabin of claim 1, wherein the catch finger is operational to be biased by the lug in a direction counter to the unlocked position when the lug abuts the catch finger.

14. The cabin of claim 1, wherein the at least one door is provided with opening and closing members, said locking and unlocking device being coupled to said opening and closing members and being disengageable.

15. The cabin of claim 1, wherein the pedal is accessible via an access hatch in the interior floor.

16. The cabin of claim 1, provided with a channel passing through the doorsill is formed for accommodating the catch finger.

17. A passenger transport facility, comprising at least one cabin wherein the cabin is supported by a movable structure that rotates about an axis of rotation relative to a fixed structure, and is rotated about an axis parallel to the axis of rotation relative to the movable structure and the cabin comprises:

at least one door that is movable between an open position and a closed position, an interior floor and a doorsill, the interior floor and the doorsill being located on either side of the door in the closed position, a locking and unlocking device comprising a lug that is rigidly connected to the door and projects toward an outside of the cabin and a catch finger that is movable between a locked position and an unlocked position, said finger being, in the locked position, an abutment on the path of the lug from the closed position to the open position of the door, wherein the catch finger in the unlocked position is retracted under the doorsill, the locking and unlocking device comprising an actuating mechanism, the actuating mechanism comprising a pedal located under the interior floor and a kinematic connection between the pedal and the catch finger, which kinematic connection is located under the interior floor and the doorsill.

* * * * *